United States Patent [19]

Pinz et al.

[11] 4,177,708

[45] Dec. 11, 1979

[54] COMBINED COMPUTER AND RECORDER FOR MUSICAL SOUND REPRODUCTION

[75] Inventors: Rochelle Pinz, 2100 Atlantic Blvd., Atlantic Beach, N.Y. 11509; Gordon Silverman, New York, N.Y.

[73] Assignee: Rochelle Pinz, Atlantic Beach, N.Y.

[21] Appl. No.: 807,733

[22] Filed: Jun. 17, 1977

[51] Int. Cl.[2] ..... G10H 3/04

[52] U.S. Cl. ..... 84/1.28; 84/1.24; 84/470 R; 84/1.19; 84/1.18; 84/1.17; 84/1.03

[58] Field of Search ..... 84/470, 1.28, 1.24, 84/1.19, 1.18, 1.17, 1.11, 1.03, 1.01

[56] References Cited

U.S. PATENT DOCUMENTS

| | | | |
|---|---|---|---|
| 2,855,816 | 10/1958 | Olson et al. | 84/1.03 |
| 3,604,299 | 9/1971 | Englund | 84/1.17 X |
| 3,639,913 | 2/1972 | Watson | 84/1.01 X |
| 3,647,929 | 3/1972 | Milde | 84/461 X |
| 3,683,096 | 8/1972 | Peterson et al. | 84/1.03 X |
| 3,781,452 | 12/1973 | Vauclain | 84/DIG. 29 X |
| 3,809,789 | 5/1974 | Deutsch | 84/1.01 |
| 3,890,871 | 6/1975 | Oberheim | 84/1.03 X |
| 3,905,267 | 9/1975 | Vincent | 84/1.03 X |
| 3,915,047 | 10/1975 | Davis et al. | 84/1.03 |
| 3,955,466 | 5/1976 | Goldmark | 84/470 |

*Primary Examiner*—Ulysses Weldon
*Attorney, Agent, or Firm*—Alexander Mencher

[57] ABSTRACT

A multichannel recording medium storer which samples the time course of notes produced by an instrument and an address for each of these samples. An interchangeable keyboard transmits a signal or signals to an electronic computer as to which note or notes are to be reproduced. The electric computer reads the note or notes to be reproduced from the recording medium and from the sample produces a faithful reproduction of the sustained note or notes. The result is available for recording on one channel of the recording medium or for reproduction on a speaker. The instrument is useful for the preparation of musical compositions and for educational purposes and demonstrations.

6 Claims, 10 Drawing Figures

COMBINED COMPUTER AND RECORDER FOR MUSICAL SOUND REPRODUCTION

BACKGROUND OF THE INVENTION

This invention relates to the field of electronic computers and magnetic tape recorders in combination. It is of a type which produces sustained notes and sequences of notes (including musical chords) from small samples of notes. Moreover, the invention provides for making permanent recordings of these sequences and can do so for any voice and device able to produce musical sound.

In the past, there have been a variety of types of apparatus for the synthesis and recording of musical sound. These devices simulate musical sound by summing components found in such sounds. As such, they never faithfully reproduce musical sounds because the summation always limits the number or phase of the components. Moreover, these synthesizers have failed to include variations in sound production for different instruments, thereby producing the same note. Furthermore, they have ignored the generation of combinations of notes to produce chords. In addition, these devices have failed to include the variations of tone properties over time. The result of these limitations has been to produce tones which are "flat" or devoid of qualities as might be found in nature.

SUMMARY OF THE INVENTION

This invention relates to a device which stores short time samples of notes or musical tones on a magnetic medium, feeds these samples to an electronic computer upon command where they are stored for as long as desired, and where they are continuously read thereby producing a sustained tone from the sample. This sustained tone is available for recording on another magnetic medium.

It is among the principal objects of this invention to provide an improved means for producing a sustained musical tone from a short time sample of that tone in order to generate a faithful reproduction of that tone.

Another object of the invention resides in provision of improved means for producing a sustained musical tone from a short time sample of that tone in order to generate a faithful reproduction of that tone.

A further object of the invention resides in provision of improved means for addressing or locating note samples within a magnetic medium.

Another object of the invention resides in means for enabling reproduction of sustained notes from time samples of those notes independently of the instrumental source of those tone samples. By using the same elements, notes may be reproduced of samples of piano, violin, flute, oboe, etc.

A further object of the invention lies in its ability to faithfully reproduce the time course of notes found in nature as they are actually produced by musical instruments.

Another object of the invention lies in its ability to produce a combination of tones simultaneously as might be found in nature in the form of a chord.

Another object of the invention lies in its ability to present the entire repetoire of notes able to be reproduced on interchangeable keyboards so that the same elements are used to select notes to be reproduced from a variety of instrumental sources.

These objects and other incidental ends and advantages of the invention will appear in the progress of the disclosure and as pointed out in the appended claims. And before proceeding with the disclosure, the following discussion is believed to be appropriate.

It is well known that a complex time varying signal may be broken down into a sum of sinusoidal time varying signals. When these signals of appropriate amplitude and phase relation are summed, the original signal may be reproduced. Moreover, signals found in nature have a property that enable them to be reproduced by summing a finite number of sinusoidally time varying signals. Such signals are referred to as "band limited". For such band limited signals, the entire time course of the signal is not needed in order to determine its sinusoidal components. If the magnitude of that signal is known at a finite number of points in time, it is possible to obtain its sinusoidal components and furthermore it is possible to reproduce the original signal from this partial representation (or sampled form). Moreover, if a signal is periodic, that is, if the signal is unique over a region of time and this unique portion is repeated over all time, then the entire signal may be reproduced from a single cycle of the periodic signal. It is the combination of the facts that only discrete portions of a signal are needed to represent it, and that a periodic signal may be reproduced through knowledge of a single cycle of that signal, that forms the basis of the present invention.

DRAWINGS OF PREFERRED EMBODIMENT

In the accompanying drawings showing a preferred form of the invention:

Figure 3A:
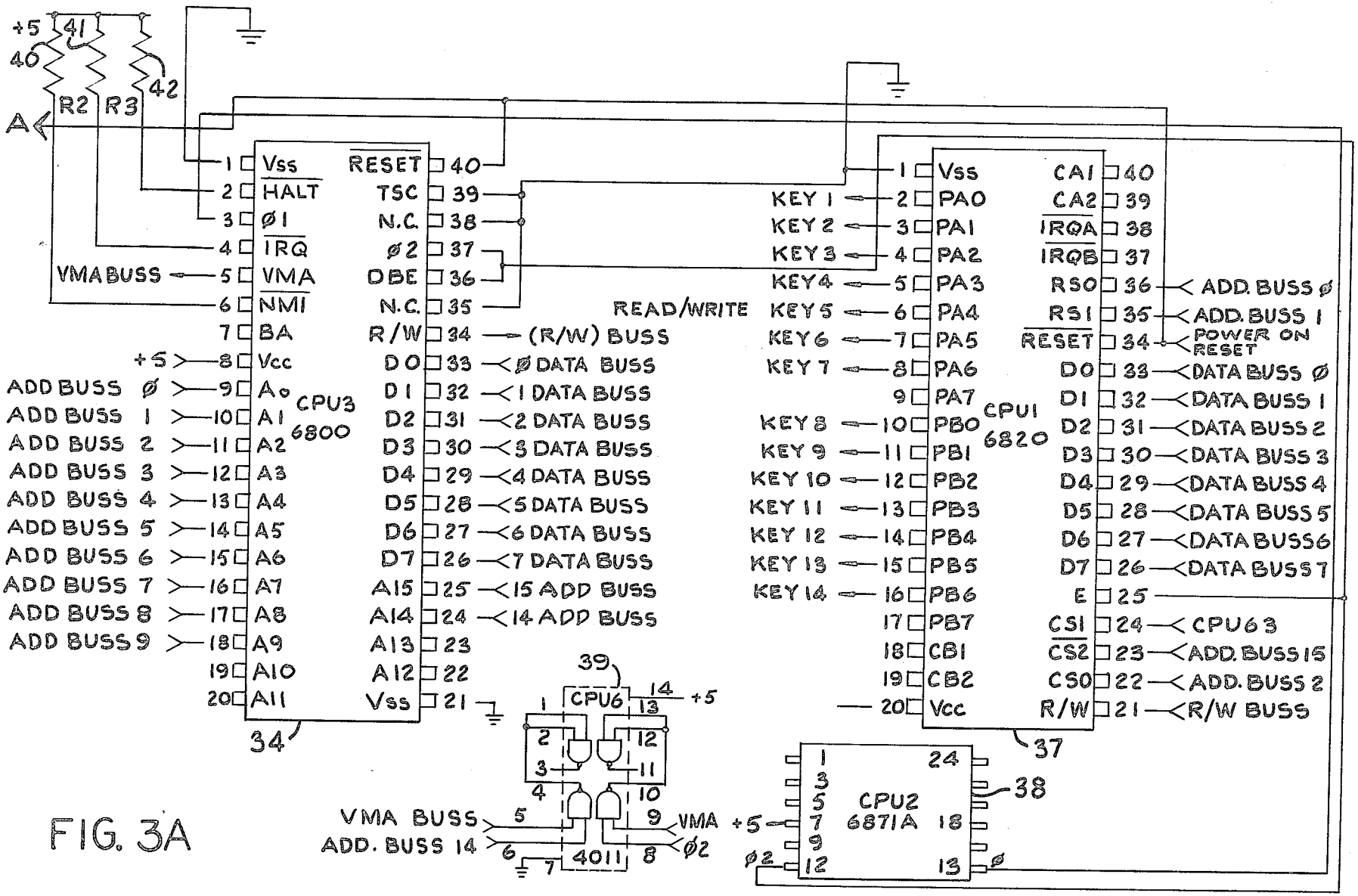
Figure 3B:
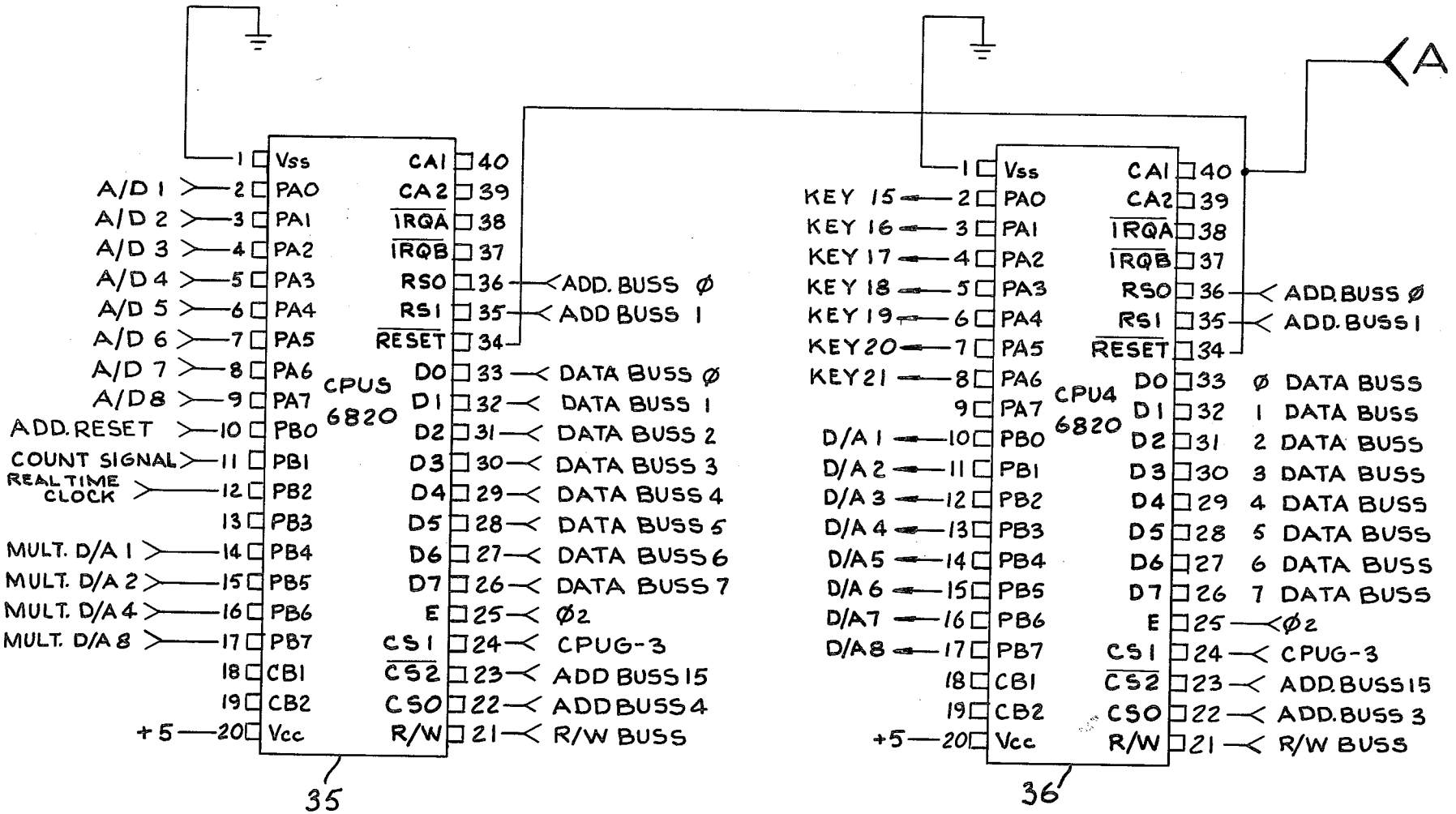
Figure 4:
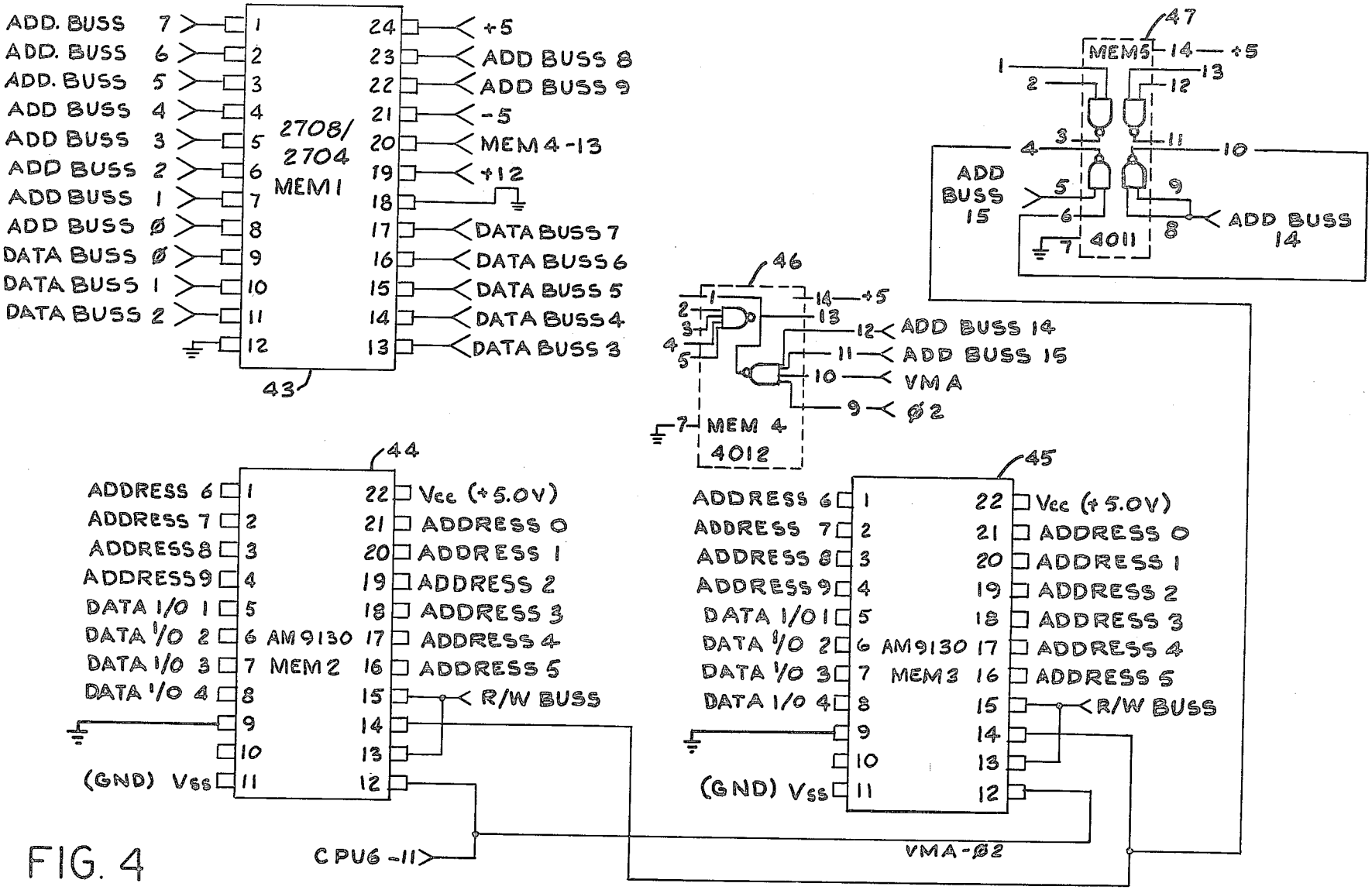
Figure 5:
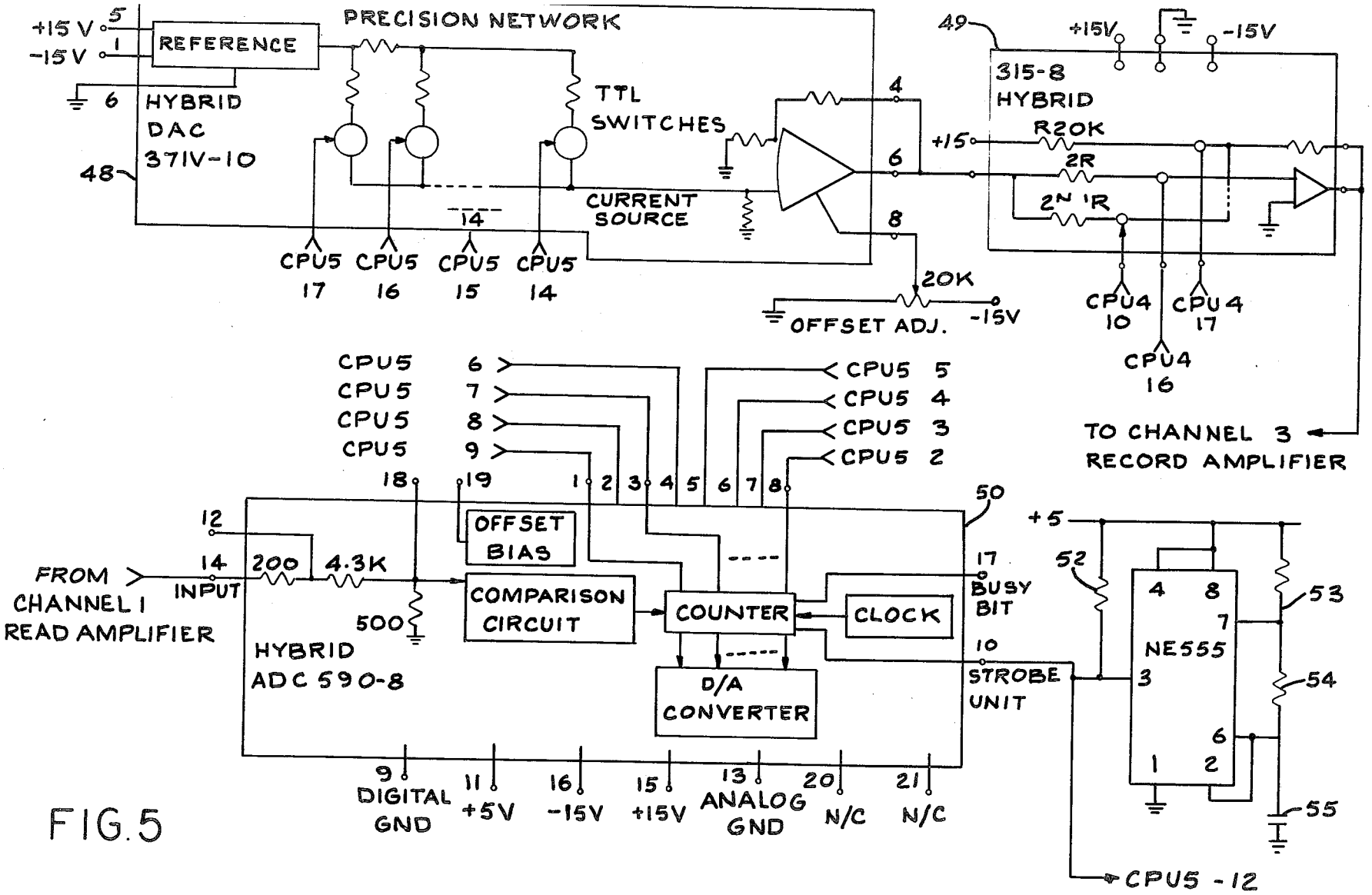
Figure 6A:
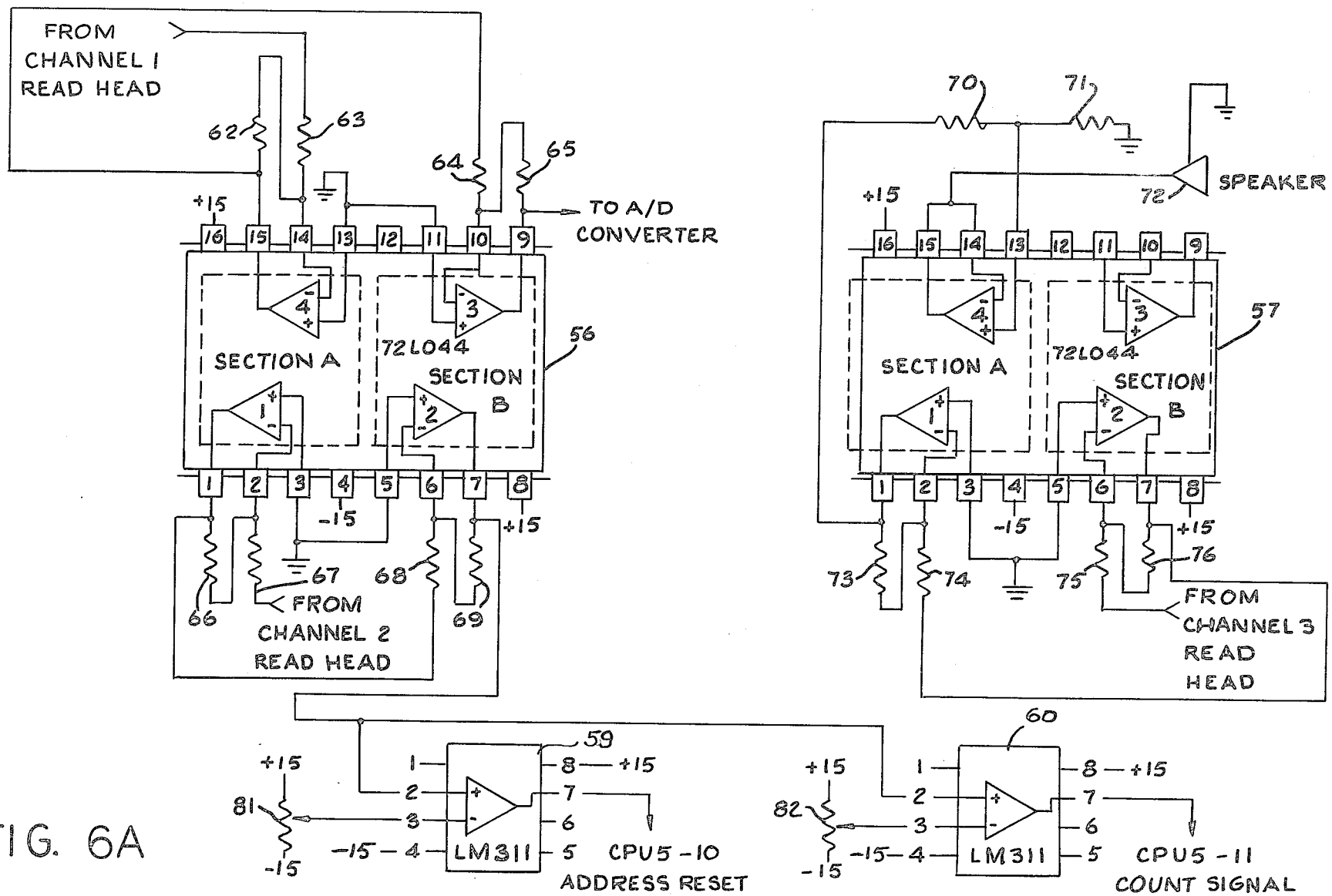
Figure 6B:
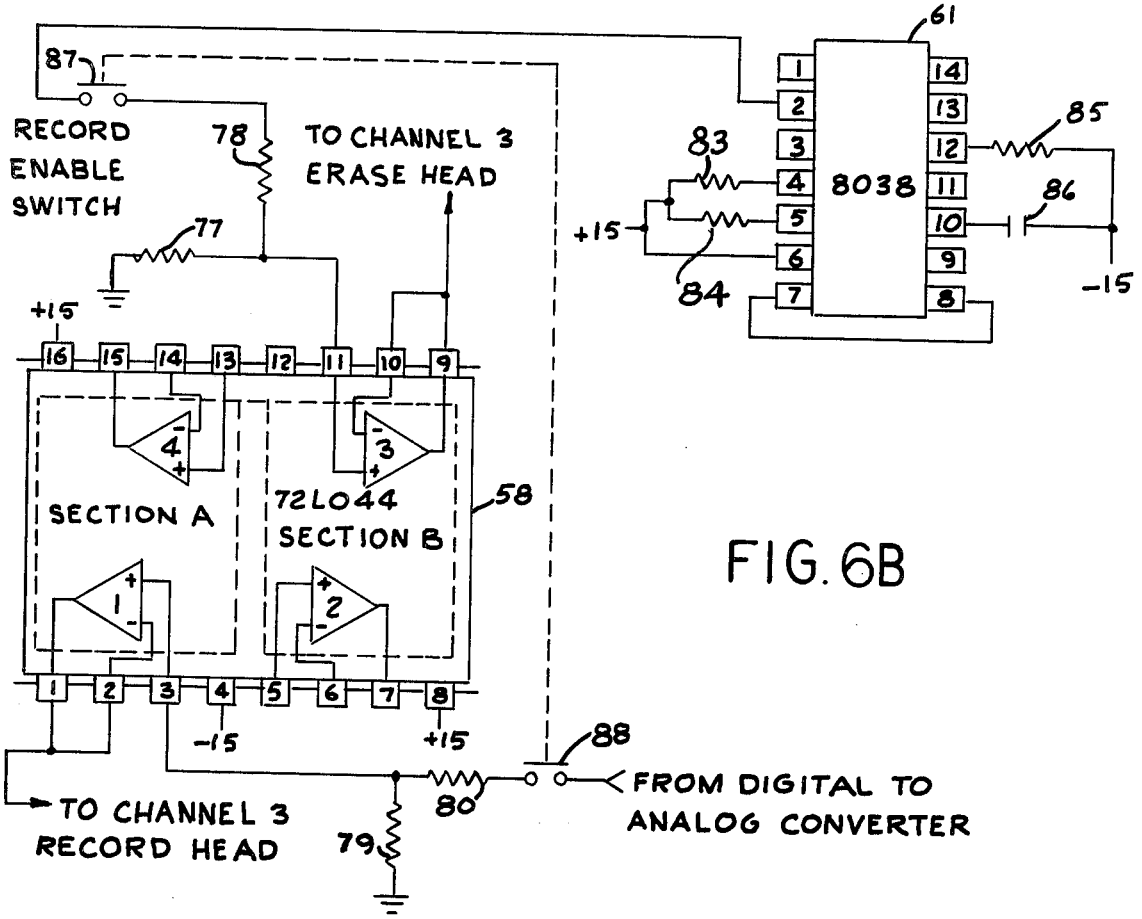
Figure 7:
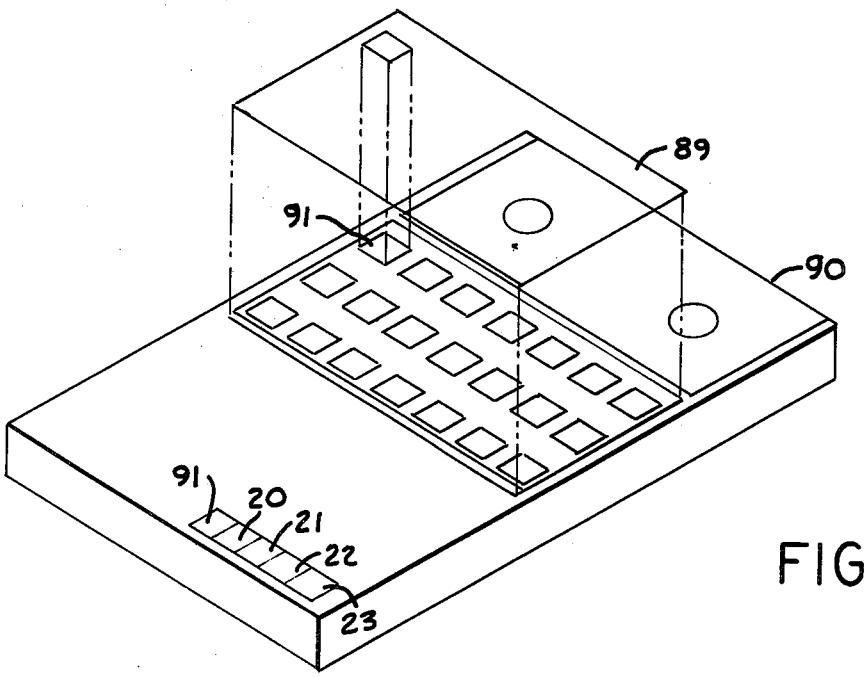

FIGS. 3A–3B, the latter being a continuation of FIG. 3A, is a schematic wiring diagram showing the electronic computer central processor;

FIG. 4 is a schematic wiring diagram showing the electronic computer memory;

FIG. 5 is a schematic wiring diagram showing the analog to digital converter, digital to analog converter and real time clock;

FIGS. 6A–6B, the latter being a continuation of FIG. 6A, is a schematic wiring diagram showing a magnetic recorder and reproducer, and FIG. 7 is a schematic drawing showing an interchangeable front panel keyboard.

DESCRIPTION OF PREFERRED EMBODIMENT

Figure 1:
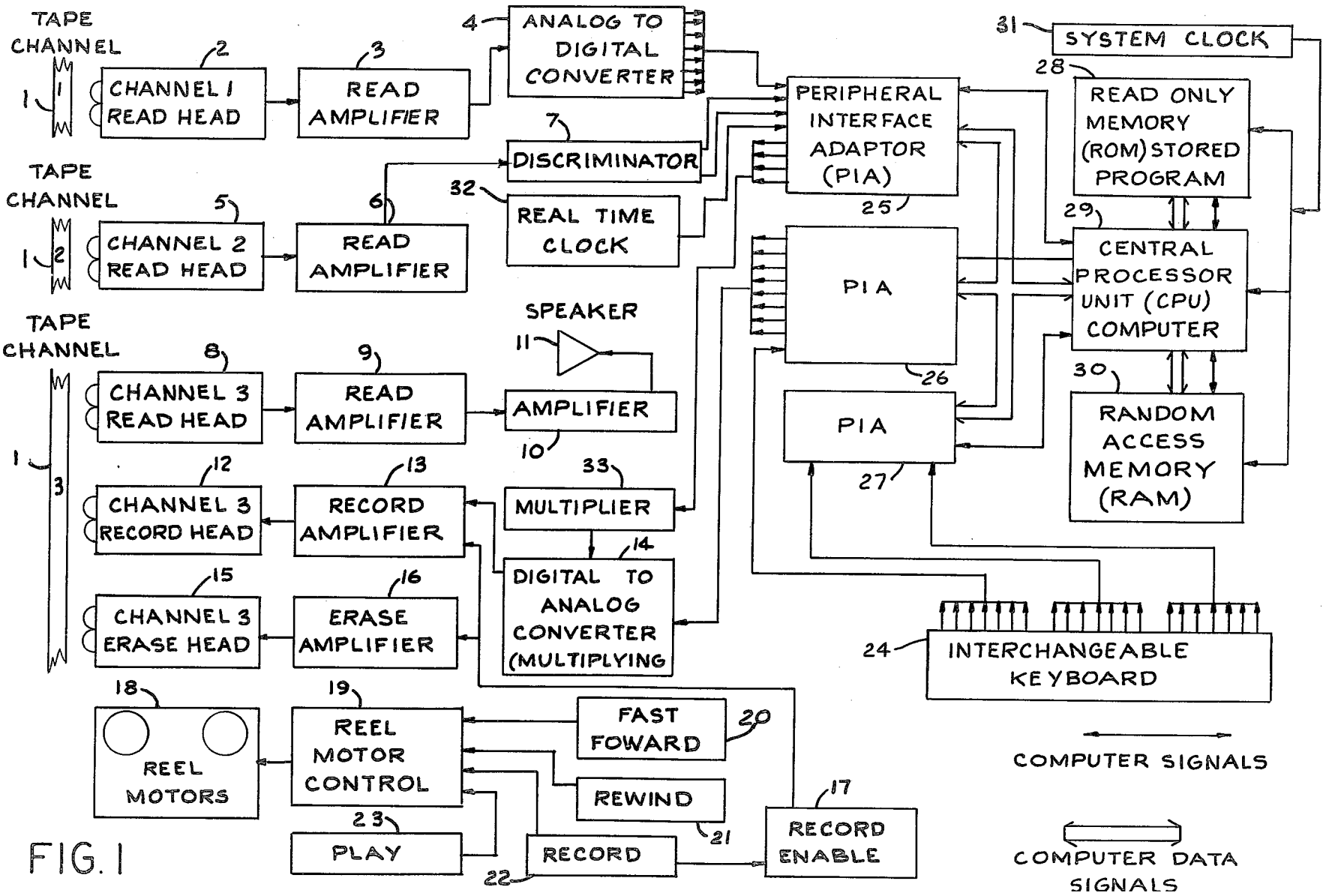
FIG. 1 is a schematic diagram of the entire system showing a multichannel magnetic recording and reproducing device and an electronic computer in combination.

As seen in FIG. 1, the device includes as part thereof a recording medium indicated by numeral 1. In this example, the recording medium is a magnetic tape which is divided into three regions. The first region (tape channel 1) includes samples of each note that may be needed. These samples appear sequentially on the tape. The entire sequence of notes can be designated as a block. These blocks appear repeatedly over the entire extent of the tape. As the tape moves, the individual notes are repeatedly available (once per block) for recording should it be required. The second region, tape channel 2, includes a mechanism whereby the individual notes on tape channel 1 may be addressed.

Said channel 2 includes a mark in correspondence with the start of a block of notes on channel 1. In addition, there is a second mark, distinct from the mark first mentioned, which is in correspondence with the start of each note within a block in channel 1. A third region of tape 1 is reserved for the recording of notes or chords and is designated as channel 3. The resultant musical compositions are available for playing back on speaker 11.

The blocks of note samples recorded on channel 1 are detected by the channel 1 read head indicated as element 2. This element converts the magnetically recorded signals to electrical signals which are subsequently amplified in read amplifier 3. The amplified signals from read amplifier 3 are the inputs to analog to digital converter 4. The output of analog to digital converter 4 is the digital equivalent of the analog signal representing the notes stored in tape channel 1. The digital output of analog to digital converter 4 is available for processing by the other elements of the computer. Read head 5 (channel 2) and read amplifier 6 function in a way similar to the corresponding elements of tape channel 1. Read head 5 detects the signals on magnetic tape channel 2 and read amplifier 6 amplifies the electrical signals produced by read head 5. The resultant electrical signals are inputs to discriminator 7. Discriminator 7 detects the two types of signals present on tape channel 2 and separates them into two distinct signals. at its output. These signals are the address reset signal which occurs whenever a block begins on tape channel 1 and a count signal which occurs at the start of each note on tape channel 1. The address reset signal and count signal are available for use by other elements of the computer. The read head for tape channel 3 (element 8) detects any notes which have been recorded on channel 3. The resultant electrical signals produced by read head 8 are amplified on read amplifier 9 and further amplified in amplifier 10 to a point where they are compatible with the requirements of speaker 11. Speaker 11 will reproduce anything which has been recorded on tape channel 3. Record head 12 is the means by which notes, chords, etc. are transformed from electrical signals into magnetic signals which are then recorded on tape channel 3. Record amplifier 13 supplies the signals to be recorded on tape channel 3 to record head 12. Record amplifier 13 receives the signals to be recorded from digital to analog converter (multiplying) 14. Record amplifier 13 receives a second signal. This signal originates in record enable 17. Record enable 17 provides a control signal which is energized (or enabled) only when the user desires to record material on tape channel 3. Thus, spurious signals will not be inadvertently recorded on tape channel 3. In addition to recording new signals on tape channel 3, old signals must be simultaneously erased. Erasure of tape channel 3 is accomplished by erase head 15. This is supplied with a signal which demagnetizes tape from erase amplifier 16. The only occasions when tape is to be erased are when new material is being recorded. Thus, erase amplifier 16 receives a control signal from record enable 17 which enables the erase amplifier 16 only during recording times.

Reel motors 18 will advance (forward or backward) the magnetic tape over the heads. To turn reel motors 18 in appropriate directions, reel motor control 19 is provided. The user is provided with a series of controls to signify intentions to the computer. Fast forward control 20 will advance the tape rapidly. Rewind control 21 causes the magnetic tape to return towards the physical start of the tape. Record control 22 initiates the recording of new material and play control 23 will allow the user to reproduce old material without recording new material.

Interchangeable keyboard 24 includes switches which represent the notes that are stored in a block on channel 1 of the magnetic tape. Since a new magnetic tape can be inserted into the device as desired, the keyboard switches have dynamic representation. A given key may represent one note for one tape and a second note for a different tape.

The peripheral interface adaptor elements 25, 26 and 27 provide compatibility between the signals internal to the electronic computer and all other elements (including all those mentioned previously). The electronic computer which controls the sequence of operations includes: the read only memory unit 28 which stores the program (sequence of operations), the control processor unit 29 which carries out the instructions stored in read only memory 28 and controls the sequence of operations, random access memory 30 provides additional memory locations which will store data that may vary from moment to moment such as the representation of the note being recorded. System clock 31 provides a timing signal to the electronic computer to properly sequence the steps carried out by the program.

Real time clock 32 provides a timing signal which is used to record notes on channel 3 of the magnetic tape in a manner which will not produce sound distortion when it is reproduced.

Multiplier 33 accepts signals from the electronic computer via peripheral interface adaptor 25. The multiplier 33 stores the magnitude of the note or notes being recorded on the magnetic tape. The magnitude of the note will be programmed to decrease with time so as to be representative of sounds produced by true instruments. Its output is one of the inputs to the digital to analog converter 14 and acts to adjust the scale factor of this latter element.

Figure 2A:
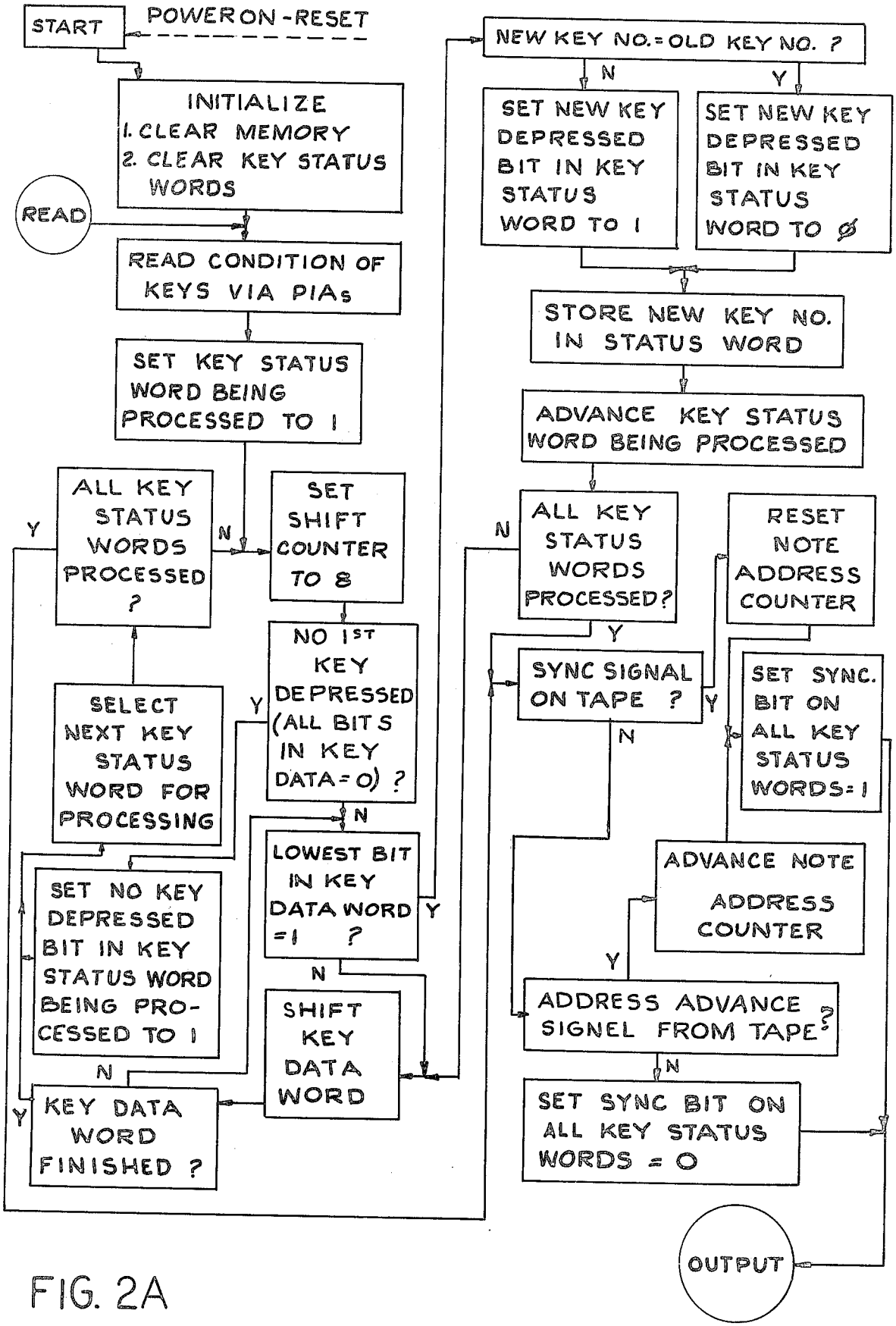
FIG. 2A is a sequence or flow diagram showing the sequence of steps that the computer follows to determine which key or keys on the keyboard have been depressed.
Figure 2B:
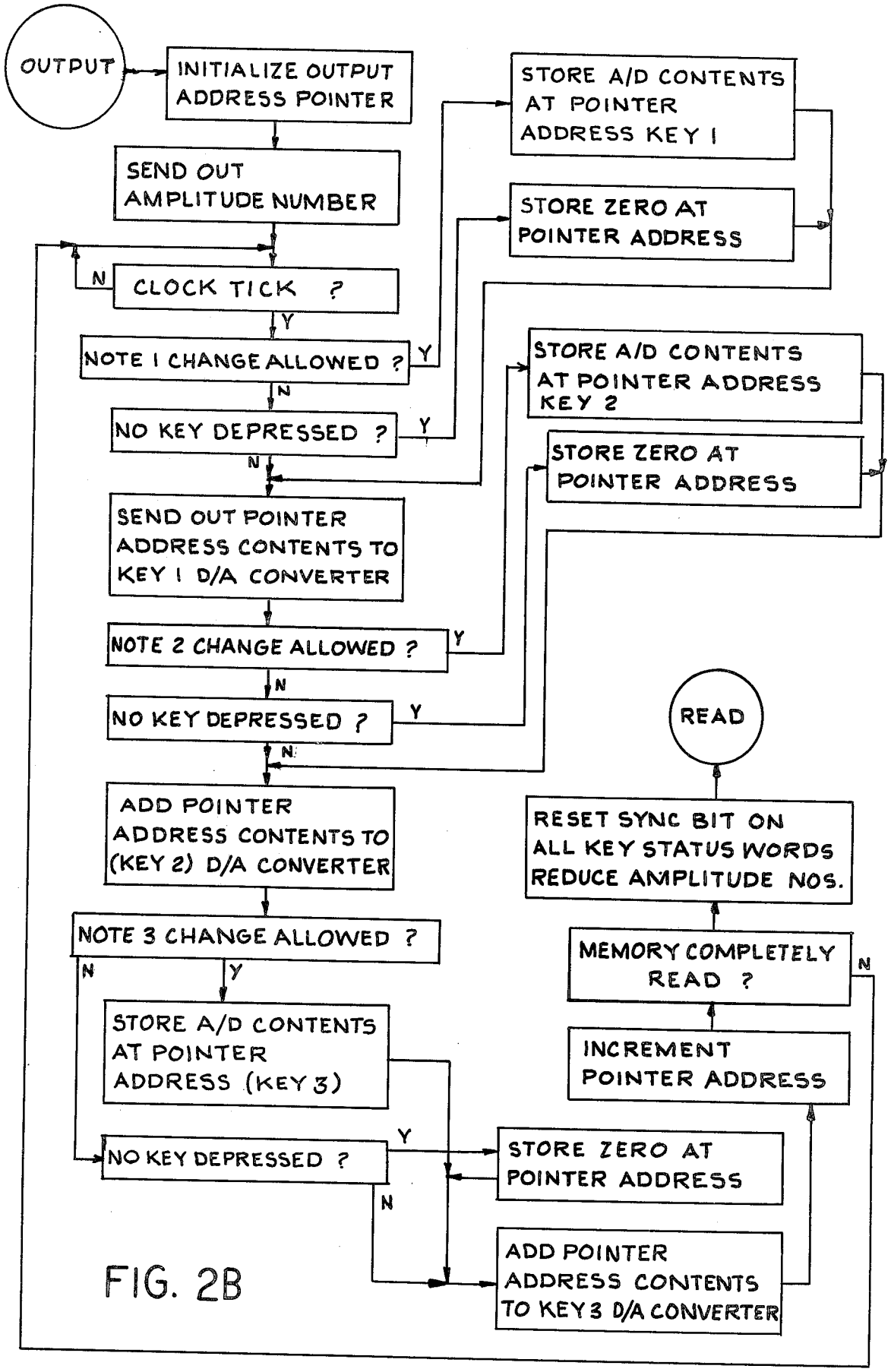
FIG. 2B is a sequence or flow diagram showing the sequence of steps that the computer follows to obtain the appropriate or notes from the magnetic record and reproduce or record a sustained note from a sample.

FIGS. 2A and 2B

The sequence of operations of the device (the program steps stored in read only memory 28) is noted in FIGS. 2A and 2B. In the diagram there shown, rectangles with "?" marks represent decision points in the program. If the condition required by the decision is satisfied at the time it is encountered, then the next operation is the one encountered by following the arrow marked by a "Y." If the condition is not satisfied, the next instruction is that encountered by following the arrow marked "N." Rectangular symbols represent operations which are carried out by the computer and its associated elements. Circular symbols represent continuation points in the program. That is, they represent the same point. If a circular symbol is encountered in a path, find another circular symbol with the same designation and continue at that point. A rectangular symbol marked "START" represents the starting point in the program. It is entered when the power is first applied to the device. The sequence of operations follows the path defined by the arrows. Traversing the lines joining the various symbols by following directions designated by the arrowheads delineates the program.

The sequence of steps carried out by the program shown in FIGS. 2A and 2B can be summarized. The electronic computor accepts data from the keyboard via peripheral interface adaptors 26 and 27. The status of the keys is determined to find out which key or keys have been depressed (if any). The computer can process up to three keys being depressed simultaneously in order to reproduce musical chords. The computer stores the number of the key or keys depressed. It ignores more than three keys. It now examines the data coming from discriminator 7. One of the memory locations of random access memory 30 stores the address (not number) of the note presently being read on channel 1 of the magnetic tape. This memory location is set to 1 each time that an address reset signal is detected by discriminator 7. For each subsequent count signal produced by the discriminator (which receives its signals ultimately from channel 2 of the magnetic tape), this memory location is incremented by 1 count. Thus, at any point in time the number stored in this memory location is in direct correlation with the note number of a note (within a block) being read by read head 2.

A series of memory locations within random access memory 30 is reserved for the notes to be recorded on channel 3 of the magnetic tape. If a key has not been depressed then these memory locations are set to zero. If a key has been depressed, two possibilities exist (each time the keyboard is interrogated). The key that is depressed may be the same key that was depressed when the keyboard was previously interrogated. In this case, whatever is stored in the random access memory locations that store the notes is left undisturbed. However, the key that has been depressed may be a key that has been newly depressed. (Past history of which keys have been depressed is stored in the random access memory 30). In this case, the number of the key that has been depressed is compared with the note number corresponding to the note sample presently being read on magnetic tape channel 1. If the two addresses (numbers) do not agree, nothing is disturbed in the random access memory locations which are reserved for the notes to be recorded on magnetic tape channel 3. If the number of the key being depressed agrees with the number of the note (within a block on channel 1 of the magnetic tape) being read (and the key being depressed is newly depressed), then a digital representation of the note being read is stored in the random access memory locations reserved for the notes to be recorded. This digital representation of the note is produced by analog to digital converter 4.

The data (digital representation of the notes to be recorded) as stored in the random access memory is sequentially addressed by control processor unit 29. The data for the three keys is added together and this data is transmitted via peripheral interface adaptor 26 to digital to analog converter 14. Digital to analog converter 14 produces an analog signal equivalent to the digital number stored in the random access memory 30. This signal is presented to record amplifier 13 for recording on channel 3 of the magnetic tape. When all memory locations of the random access memory have been addressed, the central processor unit 29 readdresses the first location and repeats the sequential interrogation of these pertinent memory locations. A small sample of a note when continuously repeated will produce a note equivalent to a sustained version of the original note.

It is to be noted that the process just described (interrogating the keyboard and entering new note samples into the random access memory) happens very rapidly (in approximately 20 milliseconds) and this does not have deleterious effects on the recording of notes.

The elements needed to carry out the program and perform the functions indicated in FIG. 1 are shown in FIG. 3A–3B, FIGS. 4, 5 and FIGS. 6A–6B.

FIGS. 3A–3B, 4, 5, and 6A–6B

FIG. 3A–3B includes peripheral interface adapter elements 35, 36 and 37. These elements are element type 6820. Element 34 is a type 6800 LSI circuit which controls the sequence of steps stored in read only memory 28. Resistors 40, 41 and 42 provide bias to control processor element 34. The clock which provides timing signals to the computer is element 38. This is a type 6871 circuit. Logic element 39 is included to provide additional control signals for the peripheral interface adaptor elements 35, 36 and 37.

FIG. 4 includes elements needed to store the program and the digital representation of the notes to be recorded. The read only memory element 43 is a type 2708 circuit. The random access memory elements 44 and 45 are type Am 9130 circuits which are combined in a manner to store 1024 digital data words. Each digital word contains eight bits of information. Element 46 and element 47 include additional logic needed to control memory elements 43, 44 and 45.

FIG. 5

FIG. 5 shows the elements needed to convert analog signals to digital representations, and to subsequently convert digital signals to analog equivalents. Digital to analog converter element 48 accepts a digital number from peripheral interface adaptor 35. Its output is an analog quantity representative of the absolute magnitude of the note to be recorded. The output of digital to analog converter 48 is coupled to digital to analog converter 49. This receives its digital input from the peripheral interface adapter 36. Its output is an analog quantity which varies in accordance with the note being recorded and whose absolute amplitude is determined by digital to analog converter 48. The output of digital to analog converter 49 controls the recording of data on channel 3 of the magnetic tape. The analog to digital converter 50 accepts an analog signal from channel 1 of the magnetic tape (the sample notes), and converts this signal into an equivalent digital quantity which is transmitted to the computor via peripheral interface adaptor element 35. A timing signal is also provided to analog to digital converter element 50. This timing signal is provided by the real time clock which is composed of elements 51, 52, 53, 54 and 55. This timing signal controls the points of time at which the analog signal is to be converted into a digital quantity. This timing signal is also supplied to the computer to control the time at which data will be converted from a digital quantity to an analog quantity to be recorded on the magnetic tape. The time signal is generated by timer 51. Resistor 52 is a bias element. Resistor 53, resistor 54 and capacitor 55 determine the timing interval.

FIGS. 6A–6B

FIGS. 6A–6B includes the functional elements necessary for recording or reproducing the recorded data. Operational amplifier 56 together with resistors 62, 63, 64 and 65 provide amplification of the signal being detected by read head 2. The resultant amplified signal is transmitted to analog to digital converter 50. Operational amplifier 56 together with resistors 66, 67, 68 and 69 amplify the signal being detected by read head 5. The output signal is obtained from resistor 69 and is transmitted to comparator amplifiers 59 and 60. Comparator amplifier 59 is combined with variable resistor 81 so that the output of comparator amplifier 59 will consist of a signal which occurs whenever an address reset signal exists on channel 2 of the magnetic tape. Comparator amplifier 60 in combination with variable resistor 82 will produce a signal whenever a count signal appears on channel 2 of the magnetic tape.

The signals recorded on channel 3 of the magnetic tape are detected by read head 8. These signals are amplified by operational amplifier 57 in combination with resistors 73, 74, 75, and 76. Further amplification is provided by operational amplifier 57 in combination with resistors 70 and 71. The resultant signal is transmitted to speaker 72 which reproduces the notes previously recorded.

When data is to be recorded on channel 3 a signal is transmitted from digital to analog converter 49 to record enable switch 88. When this is closed (during recording) the signal passes to gain adjust resistors 79 and 80 and then to operational amplifier 58. The output of this amplifier is coupled to channel 3 record head 12. To erase data previously recorded, an erase signal is generated by oscillator 61. Resistors 83, and 84 provide bias for oscillator 61. Resistor 85 and capacitor 86 determine the frequency at which oscillations occur. The output of this oscillator passes through record enable switch 87 which is closed only when recording of new material takes place. This signal passes through gain adjustment resistors 77 and 78 and is transmitted to operational amplifier 58. The output of this operational amplifier is transmitted to channel 3 erase head element 15.

FIG. 7

FIG. 7 indicates generally the arrangement of the various controls and the interchangeable keyboard. The keyboard consists of 21 controls similar to element 91. A symbol plate 89 covers these control keys and assigns key values to each control key for the particular magnetic tape 90 which has been inserted into the unit. Differing tapes will contain note samples for different instruments (i.e. piano, flute, trombone, trumpet, saxophone, etc.). A different identifier plate 89 will be inserted for each tape. Control keys for FAST FORWARD, REWIND, RECORD and PLAY are shown as elements 20, 21, 22 and 23 respectively. A power ON switch is shown as element 91.

We claim:

1. A device for storing samples of musical tones and reproducing and recording sustained tones, chords and melodies, said device comprising:

first recording means including a multiplicity of samples of tones produced by some musical instrument previously recorded on said first recording means, first conversion means for the conversion of said multiplicity of samples of tones from said first recording means into electrical signals, amplification means for the amplification of said electrical signals, a second conversion means for the conversion of said amplified electrical signals into a multiplicity of pulse signals whose states are equivalent to said tone samples, a second recording means which includes a multiplicity of address and reset signals in correspondence with said multiplicity of tone samples on said first recording means, a third conversion means for the conversion of said address and reset signals into electrical address and reset signals, a second amplification means for the amplification of said electrical and reset signals, discriminator means for the separation of said electrical address and reset signals into a distinct address signal and a distinct reset signal, keyboard means adapted to produce signals which determine which of said tone samples should be used to produce a sustained tone or tones, read only memory means which stores the sequence of operations by which said device accepts signals from said keyboard and accepts said samples of tones and produces a sustained sequence of tone or tones, random access memory means which stores said pulse signals from said second conversion means and which stores signals from said keyboard means, central processor means for receiving signals from said read only memory means and producing control signals for the reproduction of said sustained tone or tones, system clock means which includes time signals to determine when said control signals from said control processor means are to be produced, a fourth conversion means for the conversion of a second multiplicity of pulse signals initiated by said central processor means, said second multiplicity of pulse signals being representative of the time course of a note or notes into a continuous electrical signal equivalent to the state of said second multiplicity of pulse signals, a third amplification means which amplifies said continuous signal representative of the time course of a note or notes, a fifth conversion means for the conversion of said continuous signal representative of the time course of a note or notes into a magnetic signal equivalent to said continuous electrical signal, multiplier means for the adjustment of the magnitude of said continuous electrical signal being produced by said fifth conversion means, a third recording means to store said magnetic signal, a fourth amplification means for the amplification of signals from said fifth conversion means, audio means for the reproduction of the signal produced by said fourth amplification means, erasure means to produce an electrical erase signal to convert signals on said third recording means to a form which will not induce response in said first conversion means, a sixth conversion means to convert said electrical erase signal to a magnetic signal representative of said electrical erase signal, reel motor means for the forward and backward movement of said recording means, said second recording means and said third recording means, fast forward control means to initiate forward movement of said reel motor means, rewind control means to initiate backward movement of said reel motor means, and record means whereby amplification is initiated by said third amplification means and whereby electrical erase signal is initiated by said erasure means.

2. A device as set forth in claim 1 wherein said first recording means comprises an interchangeable magnetic storage means whereby a different multiplicity of samples of tones may be recorded before use in said device.

3. A device as set forth in claim 1 wherein said multiplier means comprises an adjustable amplification means whereby said central processor means adjusts the time course of said amplification means providing a means wherein the magnitude of the time course of the tone or tones to be reproduced may be varied in accordance with true instrumental sound.

4. A device as set forth in claim 2 wherein said keyboard means comprises: a functionally interchangeable set of keys each having values dependent upon the particular first mentioned magnetic storage means values previously recorded.

5. A device as set forth in claim 4 wherein said keyboard means includes a further interchangeable symbol plate adapted to control said functionally interchangeable set of keys.

6. A device as set forth in claim 1 wherein said random access memory means includes a multiplicity of storage locations, said storage locations being adapted to simultaneously store a multiplicity of pulse signals from said second conversion means and a multiplicity of corresponding signals from said keyboard.

* * * * *